US011174616B2

(12) United States Patent
Riccobene et al.

(10) Patent No.: US 11,174,616 B2
(45) **Date of Patent: *Nov. 16, 2021**

(54) WALL BLOCKS HAVING ONE OR MORE MULTI-FACETED FACES OR SIDE WALLS, WALL BLOCK SYSTEMS AND METHODS OF CONSTRUCTING A WALL

(71) Applicant: KEYSTONE RETAINING WALL SYSTEMS LLC, West Chester, OH (US)

(72) Inventors: Dominic T. Riccobene, Los Ranchos, NM (US); Thomas S. Riccobene, Albuquerque, NM (US); David M. LaCroix, St. Paul, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/898,473

(22) Filed: Jun. 11, 2020

(65) Prior Publication Data

US 2020/0299920 A1 Sep. 24, 2020

Related U.S. Application Data

(63) Continuation of application No. 16/294,177, filed on Mar. 6, 2019, now Pat. No. 10,711,425.

(60) Provisional application No. 62/640,764, filed on Mar. 9, 2018.

(51) Int. Cl.

| | |
|---|---|
| ***E02D 29/02*** | (2006.01) |
| *E04B 2/04* | (2006.01) |
| *E04C 1/00* | (2006.01) |

(52) U.S. Cl.
CPC ..... *E02D 29/025* (2013.01); *E04B 2/04* (2013.01); *E04C 1/00* (2013.01)

(58) Field of Classification Search
CPC ..... E02D 29/025; E04B 2/04; E04C 1/00
USPC ..... 52/596
See application file for complete search history.

(56) References Cited

U.S. PATENT DOCUMENTS

| | | | |
|---|---|---|---|
| 2,315,418 | A | 3/1943 | Haaker |
| 2,344,302 | A | 3/1944 | Harza |
| 2,957,278 | A | 10/1960 | Woodworth |
| 4,335,549 | A | 6/1982 | Dean, Jr. |
| 4,532,748 | A | 8/1985 | Rotherham |
| 4,738,059 | A | 4/1988 | Dean, Jr. |
| D340,772 | S | 10/1993 | Harrison |

(Continued)

FOREIGN PATENT DOCUMENTS

| | | |
|---|---|---|
| CA | 151270 | 7/2014 |
| KR | 300462839.0000 | 9/2007 |

OTHER PUBLICATIONS

Harington-FSW3pc-PSS2018 https://www.keystonewalls.com/application/files/5815/3919/3126/Harington-FSW3pc-PSS2018.pdf (Year 2018).

*Primary Examiner* — Paola Agudelo
(74) *Attorney, Agent, or Firm* — Dorsey & Whitney LLP

(57) ABSTRACT

A wall block, wall block system, method of constructing a wall or other structure and a method of manufacturing a block wherein the wall block has a front, a rear, and two side surfaces, as least one of the surfaces consisting of multiple vertically planar surfaces of differing shapes and sizes and multiple faceted surfaces of differing shapes, sizes and contours.

20 Claims, 14 Drawing Sheets

(56) References Cited

U.S. PATENT DOCUMENTS 5,348,417 A * 9/1994 Scheiwiller ..... E01C 5/00 404/41
5,732,518 A 3/1998 Roberts
6,471,440 B1 10/2002 Scheiwiller
6,907,705 B2 * 6/2005 Dean ..... E04C 1/395 405/284
7,140,867 B2 11/2006 Scherer et al.
7,208,112 B2 4/2007 Scherer
D578,224 S 10/2008 Lacas
D579,576 S 10/2008 Lacas
D584,834 S 1/2009 Lacas
D601,267 S * 9/2009 Merault ..... D25/113
7,988,382 B2 * 8/2011 Castonguay ..... E04F 13/0873 404/41
D646,400 S 10/2011 Harris
D646,401 S 10/2011 Harris
8,101,113 B2 1/2012 Castonguay et al.
D661,407 S 6/2012 Riccobene
8,268,223 B2 9/2012 Manthei
D674,510 S 1/2013 Riccobene
D680,233 S 4/2013 Riccobene
D680,663 S 4/2013 Riccobene
D680,664 S 4/2013 Riccobene
8,425,146 B2 4/2013 Merriam
8,434,971 B2 * 5/2013 Dawson ..... B28B 7/24 405/284
D686,346 S * 7/2013 Riccobene ..... D25/113
D695,918 S 12/2013 Dignard et al.
D695,919 S 12/2013 Dignard et al.
9,021,761 B2 5/2015 Riccobene et al.
D743,055 S 11/2015 MacDonald et al.
D765,270 S 8/2016 MacDonald et al.
D765,880 S 9/2016 MacDonald et al.
9,739,028 B2 * 8/2017 Riccobene ..... E02D 29/025
9,832,934 B2 12/2017 Riccobene et al.
9,834,902 B2 12/2017 MacDonald et al.
D866,799 S 11/2019 Riccobene et al.
2003/0007834 A1 * 1/2003 Bolduc ..... E01C 5/06 404/41
2008/0307740 A1 * 12/2008 MacDonald ..... B28B 7/366 52/604
2009/0293377 A1 * 12/2009 Doman ..... A01G 9/28 52/102
2014/0140766 A1 5/2014 Riccobene et al.
2014/0260059 A1 * 9/2014 Riccobene ..... E04B 2/08 52/588.1
2014/0270988 A1 * 9/2014 Riccobene ..... E02D 29/025 405/284
2015/0097312 A1 4/2015 MacDonald et al.
2016/0242364 A1 * 8/2016 Riccobene ..... A01G 9/28
2017/0022710 A1 * 1/2017 Riccobene ..... E02D 29/0266
2018/0209142 A1 * 7/2018 Ravelli ..... B28B 7/007

* cited by examiner

WALL BLOCKS HAVING ONE OR MORE MULTI-FACETED FACES OR SIDE WALLS, WALL BLOCK SYSTEMS AND METHODS OF CONSTRUCTING A WALL

This application is a continuation of U.S. Ser. No. 16/294,177, filed Mar. 6, 2019, now U.S. Pat. No. 10,711,425 issued on Jul. 14, 2020, which claims the benefit of U.S. Provisional App. No. 62/640,764 filed Mar. 9, 2018, the contents of each of which are hereby incorporated by reference herein.

FIELD OF THE INVENTION

This invention relates generally to wall blocks and the manufacture of wall blocks having one or more faces and/or side walls with recesses formed from multi-faceted surfaces; each individual faceted surface may have any variety of differing shapes, sizes and contours. This invention also relates to walls and other structures constructed from such blocks and in particular, this invention relates to a system that allows the construction of a wall or other structure with varying block faces to create an overall random and irregular surface appearance to the structure and an overall desirable aesthetic.

BACKGROUND OF THE INVENTION

Wall blocks are used in various landscaping projects and are available in a wide variety of styles. Such wall blocks have gained popularity because they are mass produced and, consequently, relatively inexpensive. They are structurally sound, easy and relatively inexpensive to install, and couple the durability of concrete or any other suitable material with the attractiveness of various architectural finishes. The shape of the block is also an important feature during the construction of a wall or other structure with the wall blocks. There are advantages to having non-parallel side surfaces on these blocks when constructing a wall. The angles formed by these side surfaces permit construction of curvilinear walls, and moreover, permit the amount of curvature to vary according to the terrain and desired appearance of the wall. Numerous methods and materials exist for the construction of walls and other structures with such blocks.

Another important feature of wall blocks is the appearance of the block. Typically, wall blocks are manufactured to have the desired appearance on the front face (i.e., the outer face of a wall) only. Many manufacturers vary the color and the texture or pattern on this front face as desired because creating a random pattern in the face of a wall or other structure is highly desirable. Alternatively, manufacturers may produce multiple block shapes/sizes for use in the construction of a wall or other structure to create a random pattern in the structure and to give the visually exposed surfaces of the structure a more overall irregular or non-repeating appearance. This is inefficient from a production standpoint because this requires multiple molds and more kinds of blocks to inventory. If only one face of the block is intended to be the front face, then the block system will suffer a trade-off between having enough face sizes to create a random, natural appearance and the cost and inefficiency of using multiple molds and creating multiple inventory items.

It would be desirable to provide a system of blocks for constructing a wall or other structure that combines the ease of installation of modern segmental wall block units with the attractive appearance of a random, irregularly patterned wall composed of wall blocks of varying face embodiments with only one size of block. The block system should be efficient, easy to use and allow the construction of walls with 90 degree corners and the construction of freestanding walls and other structures. It would also be desirable to provide a wall block and multiple wall block embodiments that could be used in multiple orientations to maximize the random appearance of any exposed surface of the structure constructed with the blocks.

SUMMARY OF THE INVENTION

In an embodiment, the invention provides a wall block, wall block system, method of constructing a wall or other structure and a method of manufacturing a block wherein the wall block has a front or first face, a rear or second face, and two side surfaces, at least one of the front face, rear face, and the two side surfaces consisting of multiple vertically planar surfaces of differing shapes and sizes and multiple faceted surfaces of differing shapes, sizes and contours. The block may also have a side surface that is non-orthogonal to the front and rear face and that may be vertically planar. It should be understood that the blocks of the present may be of any type, size, shape, or dimension as desired. It should further be understood that the block could be a retaining wall block, a CMU (Concrete Masonry Unit) block, a wall panel, a tile, a veneer or other similar building/construction product. In the construction of a wall or other structure with the blocks of the present invention, the front and rear faces along with their orientations may be interchangeable as they may have similar multi-faceted irregular appearances; that is, these faces may be either the front or the back of the block and may be positioned with the top surface facing up or the top surface facing down. The front face of the wall block may have a greater surface area than the rear face. In addition, in one embodiment at least one side surface may have a similar multi-faceted irregular appearance as that of the front and rear faces. Thus, depending upon the dimensions of the block, the block may be rotated such that any of the front, rear and at least one of the side surfaces can be the "front" of the block.

Any or all of the front or first face, rear or second face and side surfaces of the wall block may have one or more geometric or prismatic indentations or recesses. Each geometric recess can be formed from a corresponding geometric or prismatic projection in the liner or side wall of the mold cavity as the wall block is molded. Each geometric recess (and geometric projection) can have any desired three dimensional geometric or prismatic shape as desired. Additionally, the shape of the three dimensional geometric or prismatic recess (and geometric projection) can have any dimension as desired. Further, the complexity of the shape of each three dimensional geometric or prismatic recess (and geometric projection) can vary greatly, such that, the geometric recess may have any number of faceted surfaces corresponding to the number of sides/surfaces of the geometric projection of the mold that imparts the three dimensional shape of the recess into the face of the block during the molding process. The faceted surfaces of each geometric recess (and geometric projection) may have any desired contour and may be curvilinear, planar or any other desired contour. In one desirable embodiment, all the faceted surfaces of each recess or indentation in each face of the block may have a drafting contour or drafting angle relative to the formation of each individual surface in a mold cavity, as known in the art, such that a block formed in a mold cavity may be readily stripped from the mold cavity. The mold cavity may have fixed or static side walls with no undercutting, and may have each geometric projection that forms the recess or indentation in the face of the block fixedly attached to each or any side wall of the mold cavity as desired. This manufacturing method allows for faster and lower cost block production. It should be understood however, that this is not limiting, and depending upon the application the mold cavity could utilize removable liners with movable mold cavity side walls.

The one or more geometric or prismatic recesses or indentations on each face of the block create shadowing effects along the faces of the block that enhance the visual aesthetic of the block. Additionally, the differing variations of the faceted surfaces that form each individual recess or indentation in the surfaces of the blocks used in the assembly of a wall or other structure give the visually exposed surfaces of the structure more visual movement, irregularity and randomness. Irregularity or irregular appearance in this context may be defined to mean that a regular geometric pattern is not readily apparent either in the individual face of the block or the visually exposed surface of a structure even though surfaces of the block, block faces and overall structure may consist of straight line segments or regular geometric curved segments. Further, the irregularity or randomness of the visually exposed surfaces of the structure may be enhanced by assembling the structure with multiple embodiments of blocks having different variations of indentations and recesses and with some of the blocks having the top surface of the block (as manufactured in a mold) facing upward and with some of the blocks with the bottom surface of the block (as manufactured in a mold) facing upward. Also, assembling the structure such that any of the front face, rear face, top surface or side faces may form any part of the visually exposed surfaces of the structure, whether the block be top side up, bottom side up, will further enhance the irregularity and randomness of the visually exposed surface. The more randomness/irregularity when assembling/positioning the blocks in the structure also helps to create more randomness and irregularity in the visually exposed surfaces of the wall.

In an embodiment the invention provides a wall block system that includes a plurality of wall blocks having a block body with a top surface opposed to a bottom surface, a first side surface opposed to a second side surface, and a front face opposed to a rear face, the block body having a height as measured from the top surface to the bottom surface, the front face, rear face and side surfaces having an outermost surface, at least one of the front face, rear face and side surfaces having at least a first type geometric indentation recessed into the block body from the outermost surface, the first type geometric indentation separating a first vertically planar portion of the outermost surface from a second vertically planar portion of the outermost surface. The wall block system including that the first type geometric indentation has at least first and second faceted surfaces, the first faceted surface having a planar contour and the second faceted surface having a non-planar contour, the first and second faceted surfaces each narrow along the height of the block from the top surface towards the bottom surface, the first and second faceted surfaces each extending outward along the height of the block from the top surface towards the bottom surface. The wall block system including that the first vertically planar portion of the outermost surface forms a first edge with the first faceted surface of the first type geometric indentation that is straight and the second vertically planar portion of the outermost surface forms a second edge with the second faceted surface of the first type geometric indentation that is curvilinear.

The wall block system may include that during the assembly of a structure with at least a first course of wall blocks having at least one visually exposed surface, any one of the plurality of wall blocks may be positioned in the at least one course with any of the front face, rear face or side surfaces forming a part of the visually exposed surface. The wall block system may also include that any of the plurality of wall blocks may be positioned in the at least one course of wall blocks with the top surface of the wall block facing upward or the bottom surface of the wall block facing upward. The wall block system may include that during the assembly of a structure having at least a first lower course of wall blocks and a second upper course of wall blocks with at least one visually exposed surface, the upper course of wall blocks is assembled with a plurality of wall blocks having a top surface with at least a first geometric indentation recessed into the block body from an uppermost surface, the first geometric indentation separating a first horizontally planar portion of the uppermost surface from a second horizontally planar portion of the uppermost surface, the first geometric indentation having at least first and second faceted surfaces.

The wall block system may include that at least one of the front face, rear face and side surfaces of at least some of the plurality of wall blocks has at least a second type geometric indentation recessed into the block body from the outermost surface, the second type geometric indentation separating one vertically planar portion of the outermost surface from another vertically planar portion of the outermost surface, wherein the second type geometric indentation has at least first and second faceted surfaces, the first faceted surface having a non-planar contour and the second faceted surface having a non-planar contour, and wherein one of the vertically planar portions of the outermost surface forms an edge with the first faceted surface of the second type geometric indentation that is curvilinear and the other of the vertically planar portion of the outermost surface forms an edge with the second faceted surface of the second type geometric indentation that is curvilinear. The wall block system may further include that at least one of the front face, rear face and side surfaces of at least some of the plurality of wall blocks has at least a third type geometric indentation recessed into the block body from the outermost surface, the third type geometric indentation separating one vertically planar portion of the outermost surface from another vertically planar portion of the outermost surface, wherein the third type geometric indentation has at least first and second faceted surfaces, the first faceted surface having a planar contour and the second faceted surface having a planar contour, and the system including that one of the vertically planar portions of the outermost surface forms an edge with the first faceted surface of the third type geometric indentation that is straight and the other of the vertically planar portion of the outermost surface forms an edge with the second faceted surface of the third type geometric indentation that is straight.

The wall block system may include that each of the front faces of the plurality of wall blocks have at least two of any of the first, second and third types of geometric indentations. The wall block system may further include that each of the rear faces and at least one of the side surfaces of the plurality of wall blocks have at least one of any of the first, second and third types of geometric indentations. The wall block system may further include that at least one of the front face, rear face and side surfaces of at least some of the plurality of wall blocks has at least a fourth type geometric indentation recessed into the block body from the outermost surface, the fourth type geometric indentation separating a vertically planar portion of the outermost surface from another vertically planar portion of the outermost surface, wherein the fourth geometric indentation has at least first, second, third and fourth faceted surfaces and wherein at least two of the faceted surfaces are non-planar and at least one of the faceted surfaces is planar.

In an embodiment the invention provides a mold assembly for producing wall blocks having a block body with a top surface opposed to a bottom surface, a first side surface opposed to a second side surface, and a front face opposed to a rear face, the block body having a height as measured from the top surface to the bottom surface, the front face, rear face and side surfaces having an outermost surface located, at least one of the front and rear faces having at least first and second geometric indentations recessed into the block body from the outermost surface, the first geometric indentation separating a first vertically planar portion of the outermost surface from a second vertically planar portion of the outermost surface, and the second geometric indentation separating the second vertically planar portion of the outermost surface from a third vertically planar portion, the first geometric indentation having at least first and second faceted surfaces, the first faceted surface having a planar contour and the second faceted surface having a non-planar contour, the first and second faceted surfaces each narrow along the height of the block from the top surface towards the bottom surface, the first and second faceted surfaces each extending outward along the height of the block from the top surface towards the bottom surface, and the second geometric indentation having at least first and second faceted surfaces, the first and second faceted surfaces each narrow along the height of the block from the top surface towards the bottom surface, the first and second faceted surfaces each extend outward along the height of the block from the top surface towards the bottom surface, the mold assembly including a production pallet; a stripper shoe; and a mold box including opposed front and rear walls and opposed first and second side walls which together with the front and rear walls form a perimeter of at least one mold cavity shaped to form a block during a block forming process, the mold box having an open top and an open bottom, the production pallet enclosing the open bottom of the mold box during a block forming process, the stripper shoe enclosing at least a portion of the open top of the mold box during a block forming process, at least one of the front and rear walls of the mold assembly having a molding surface that forms the at least first and second geometric indentations into the at least one of the front and rear faces of the wall block.

The mold assembly further including that the stripper shoe has a molding surface and that the molding surface of the stripper shoe molds at least a first geometric indentation into the block body in the top surface of the block, the first geometric indentation separating a first horizontally planar portion of the uppermost surface of the top surface from a second horizontally planar portion of the uppermost surface, the first geometric indentation having at least first and second faceted surfaces.

It should be understood that the number, location, shapes and dimensions of geometric or prismatic recesses or indentations are not limiting, thus any or all of the front face, the rear face, the side surfaces and the top surface can have any number, location, shape or dimension of geometric or prismatic recesses or indentations as desired. Any or all of the front face, rear face, side surfaces and top surface may also have false joints of varying widths and depths.

DETAILED DESCRIPTION OF THE PREFERRED EMBODIMENTS

Figure 1:
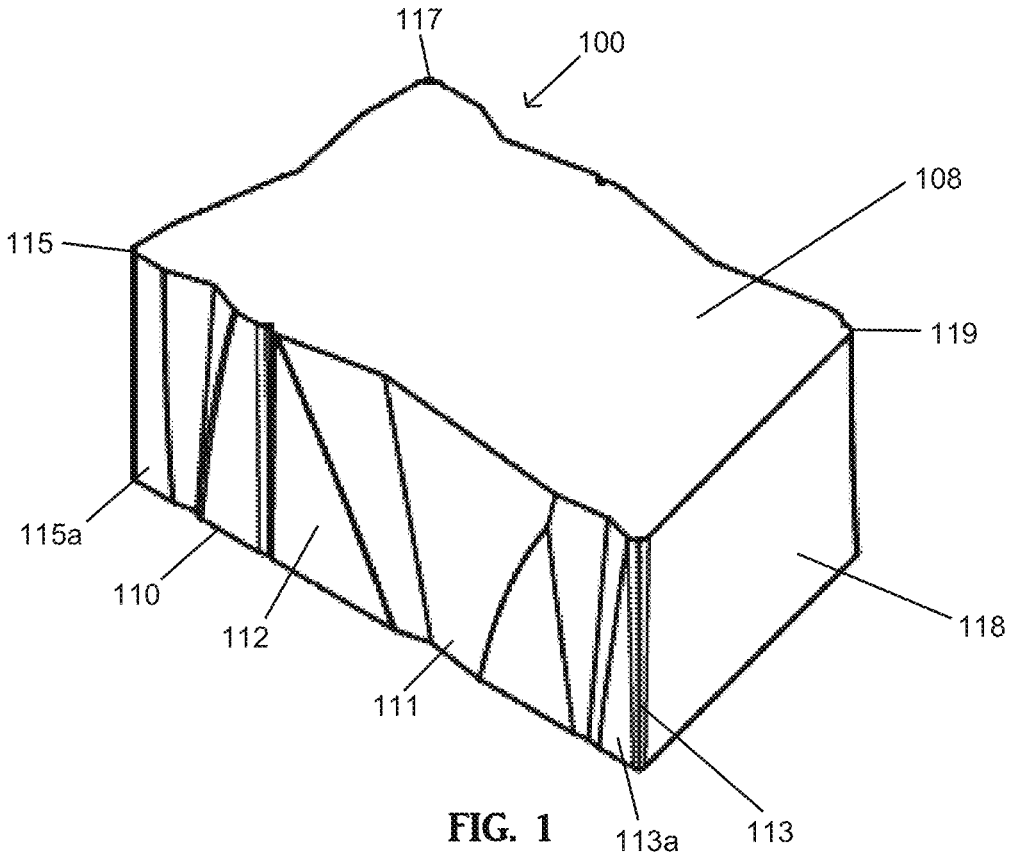
FIGS. 1 to 7 illustrate a perspective front view, a perspective rear view, a front view, a rear view, a top view, a bottom view, and an orthogonal side view of a wall block according to this invention.

In this application, "upper" and "lower" refer to the placement of the block in a wall. The lower, or bottom, surface may be placed such that it faces the ground, the lower surface may be the bottom surface of the block as manufactured in a mold cavity or may be the top surface of the block as manufactured in a mold cavity (the upper surface may be the top surface of the block as manufactured in a mold cavity or the bottom surface of the block as manufactured in a mold cavity), as such, the block may or may not be oriented in the wall in a flipped position relative to its manufacture in the mold cavity. During construction of a wall, one row of blocks is laid down, forming a course. An upper course may be formed on top of this lower course by positioning the lower surface of one block on the upper surface of another block. It should be understood that the placement of a block in each course of a wall is not limiting and any of the front, rear or side faces of any one block may be used to form the front (or visually exposed) surface of the wall or structure. The front and rear faces (and side surfaces) of one block may also have different surface areas. These features contribute to the random appearance and the irregularity of the pattern of the wall as well. Additionally, the blocks can be positioned with the top surface (as manufactured in a mold cavity) facing upward or downward, which combined with altering the orientations of the front face, rear face, side surfaces of each block relative to another block (and/or multiple block embodiments) changes/alters the appearance/aesthetic of the visually exposed surface of the wall, further enhancing the desired random/nonrepeating/irregular appearance of the wall.

One aspect of this invention is a block system that may comprise multiple embodiments of blocks with differently dimensioned, interchangeable front and back faces. The blocks can be used to construct an eye pleasing, irregularly patterned wall having multi-faceted surfaces and vertically planar surfaces. The irregular and random pattern of the surface of the wall is due to the variation in the number, shape and contour of the faceted and vertically planar surfaces of the blocks, the number, shape and contour of the faceted and vertically planar surfaces of any or all of the individual faces of each embodiment of the blocks, and the placement/orientation of the blocks in the wall or other structure that is assembled. The front and rear faces of the block may be interchangeable and either side face may be used for any visually exposed surface of the structure being constructed to increase the overall randomness, irregularity, variety and complexity of the appearance of the exposed surfaces of the structure. In addition, one or both side faces may be used for any visually exposed surface of the structure. The shape of the block may also permit the construction of stable walls and other structures having curved, or serpentine, shapes. It should be understood that blocks of the present invention may be of any type, size, shape, or dimension as desired, and, as such, the specific shape of block shown in the drawing figures is not limiting.

The blocks may be provided with pin holes, pin-receiving apertures, channels, or cores, which, along with pins that are adapted to be received in the pin-receiving apertures, may form an attachment system among the blocks in a structure. Any number, shape and size of pin holes, apertures, channels, cores and pins could be used, as known in the art.

Figure 2:
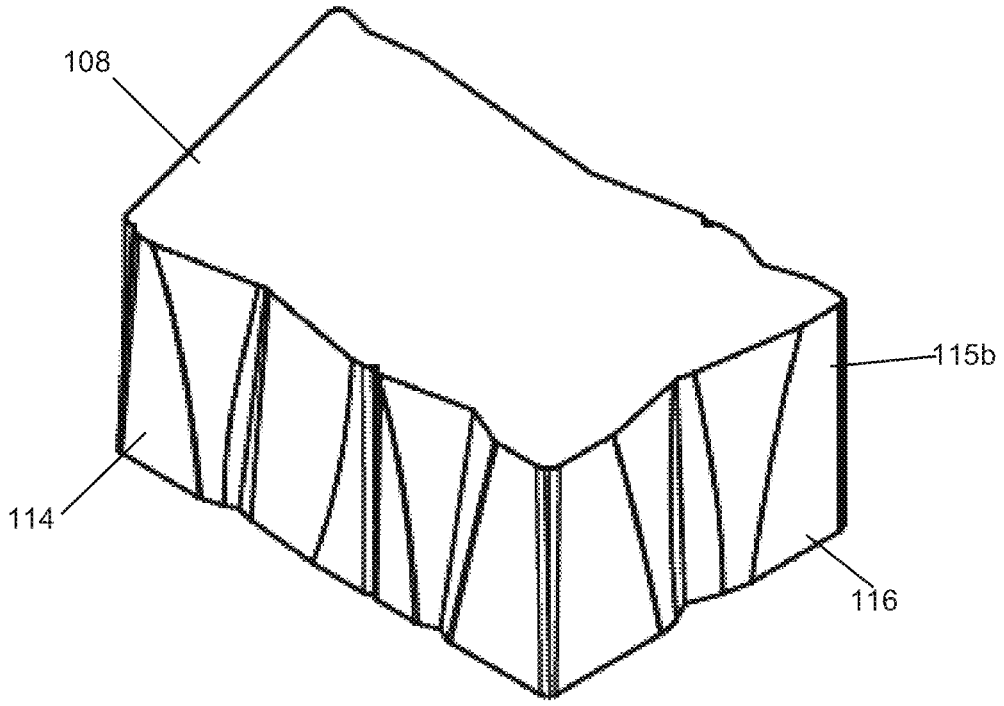

FIGS. 1 to 7 illustrate block 100 of this invention. A front perspective view of block 100 is shown in FIG. 1, a rear perspective view is shown in FIG. 2 and front, rear, top, bottom and orthogonal side surface views are shown in FIGS. 3 to 7, respectively. It should be understood that these views are relative to the manufacture of the block in a mold cavity and, as such, the orientation of the block itself may be flipped when assembled in a wall or other structure such that the top may be the bottom and the bottom may be the top. Upper or top surface 108 is opposed to and substantially parallel to lower or bottom surface 110. Upper surface 108 is separated from lower surface 110 by the height or thickness of the block. Front or first face 112 is opposed from rear or second face 114. Front or first face 112 has a greater surface area than rear or second face 114. Front face 112 and rear face 114 are joined by and may be orthogonal to first side surface 116. That is, the angle formed by an imaginary line coincident with first face 112 and an imaginary line coincident with first side surface 116 may be 90 degrees. Similarly, the angle formed between rear face 114 and first side surface 116 may be 90 degrees. Front face 112 and rear face 114 also are joined to second side surface 118. Side surfaces 116 and 118 are opposed and are non-parallel, and second side surface 118 may have a greater surface area than side surface 116. The angles formed between either of the first and second faces and second side surface 118 are non-orthogonal. That is, one angle will be acute and one will be obtuse.

The side surfaces, including the front and rear faces of block 100, meet to form corners. For example, front or first face 112 meets second side surface 118 to form corner 113. Front or first face 112 meets first side surface 116 to form corner 115. Rear or second face 114 meets first side surface 116 to form corner 117 and rear face 114 meets second side surface 116 to form corner 119. Each corner is formed by the intersection of the projections of vertical planar surfaces directly adjacent to each corner. For example, corner 113 is formed by vertical planar surface 113*a* of front face 112 and the vertically planar surface of second side surface 118. Corner 115 is formed by vertical planar surface 115*a* of front face 112 and vertically planar surface 115*b* of first side surface 116. Corner 117 is formed by vertically planar surface 117*a* of rear face 114 and vertically planar surface 117*b* of first side surface 116. Corner 119 is formed by vertically planar surface 119*a* of rear face 114 and the vertically planar surface of second side surface 118. The vertically planar surfaces of each corner may directly meet/abut/adjoin each respective vertically planar surface to form a sharp corner. Alternatively, the vertically planar surfaces forming each respective corner may be given a radius, a bevel or multiple angled surfaces, as desired, to reduce the sharpness/severity of the corner and/or to create additional shadowing effects on the true joints located between adjacently positioned blocks in a structure.

FIGS. 1 to 4 and 7 show block 100 having front or first face 112, rear or second face 114 and second side surface 116 that each comprise an outermost surface having multiple vertically planar surfaces of differing shapes and sizes and multiple faceted surfaces of differing shapes, sizes and contours. The multiple vertically planar surfaces of the outermost surface are located along a vertical plane and may be separated or segmented from one another by one or more faceted surfaces of geometric indentation/recess, discussed further below. Second side surface 118 is sometimes referred to as the angled side or non-orthogonal side because it may form non-orthogonal angled corners with the front and rear faces. Second side surface 118 may be smoother than the other faces, and could be vertically planar. It should be understood that any number or all of the side surfaces (including the front and rear faces) of the wall block can have any desired number (or none) of the vertically planar surfaces and any desired number (or none) of the faceted surfaces. Additionally, it may be desirable in some applications, that the vertically planar surfaces have a texture/pattern and/or a non-vertical planar contour. In the construction of a wall or other structure with the blocks of the present invention, front and rear faces 112 and 114 may be interchangeable as they have a similar multi-faceted irregular appearance; that is, these faces may be either the front or the back of the block. In addition, side surface 116 has a similar multi-faceted irregular/random appearance as first and second faces 112 and 114. Thus, depending upon the dimensions of the block, the block may be rotated such that any of faces 112, 114, and 116 can be the "front" of the block.

Figure 3:
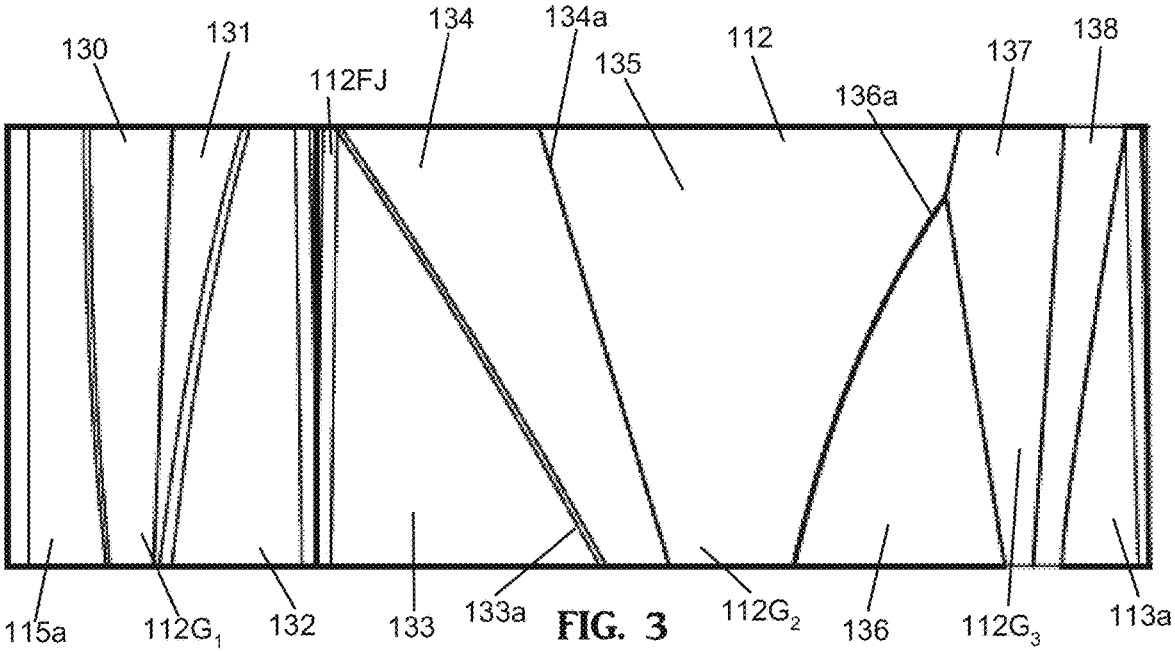
Figure 5:
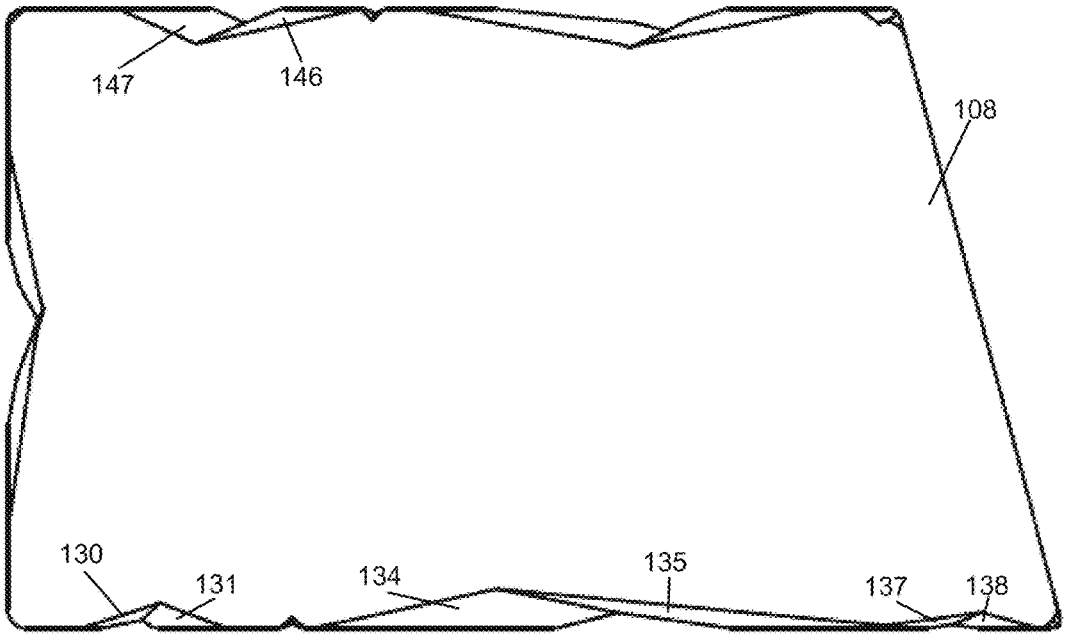
Figure 6:
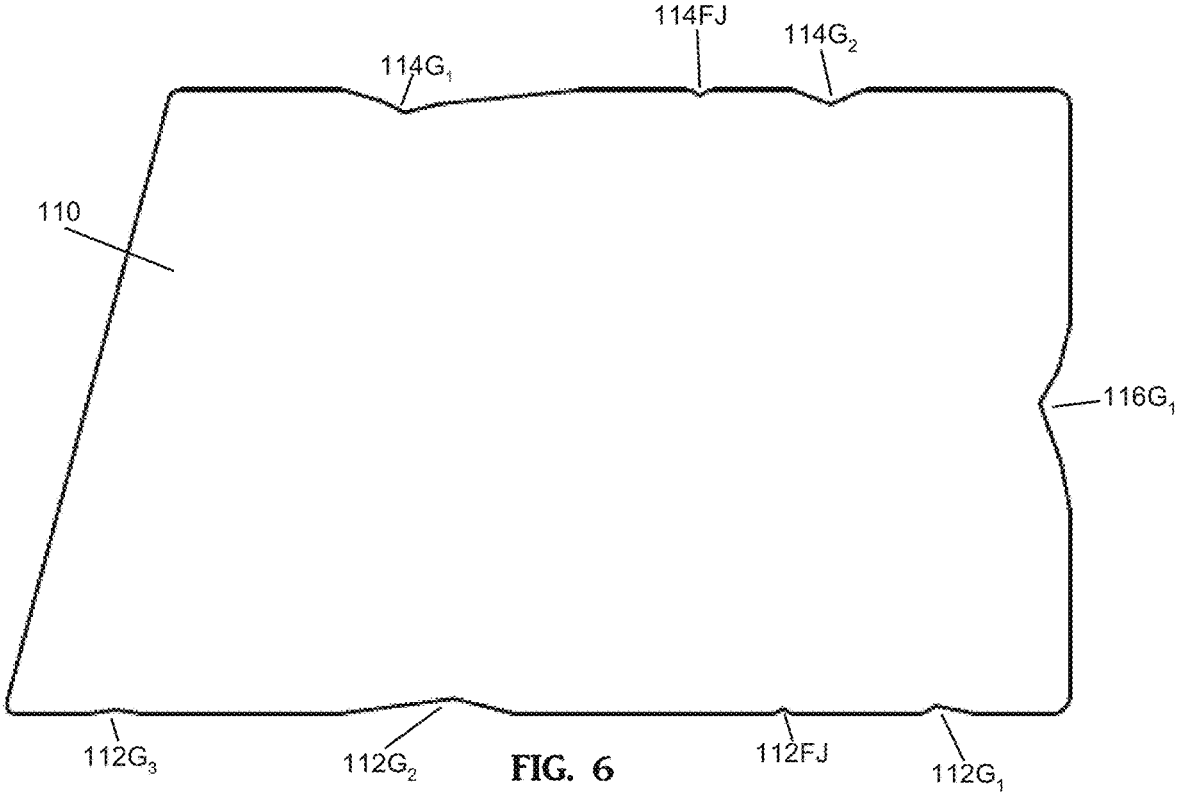

Referring to FIGS. 1, 3, and 6, front face 112 of block 100 has geometric or prismatic indentation or recess 112$G_1$, geometric or prismatic indentation or recess 112$G_2$, and geometric or prismatic indentation or recess 112$G_3$. Each geometric recess or indentation is recessed into the block body from outermost surface 111 of front face 112, thus separating vertically planar surfaces 115*a*, 132, 133, 136 and 113*a* from one another. Each geometric recess of front face 112, or other block side/surface, is formed from a corresponding geometric or prismatic projection in the liner of the mold cavity as block 100 is molded. Each geometric recess (and geometric projection) can have any desired three dimensional geometric or prismatic shape as desired. Additionally, the shape of the three dimensional geometric or prismatic recess (and geometric projection) can have any dimension as desired. Further, the complexity of the shape of each three dimensional geometric or prismatic recess (and geometric projection) can vary greatly, such that, the geometric recess may have any number of faceted surfaces corresponding to the number of sides/surfaces of the geometric projection that imparts the three dimensional shape of the recess into the face of the block during the molding process. Surfaces of the geometric or prismatic indentation/recess may be warped or curved or have some other type of distortion to add variability and complexity to the shape of the indentation/recess. Front face of block 100 also has false joint 112FJ. Geometric recess 112$G_1$ has faceted surface 130 and faceted surface 131. Faceted surface 130 extends angularly into block body 120 from vertically planar surface 115*a* and faceted surface 131 extends angularly into block body 120 from vertically planar surface 132. Additionally, as can be seen in FIG. 5, both faceted surfaces 130 and 131 may have a drafting or angular drafting contour extending into the block body along the height of the body from the bottom surface 110 to the top surface 108. As such, the width and the depth of geometric recess 112$G_1$ increases from bottom surface 110 towards top surface 108. This contouring/drafting allows the block to release from the mold cavity without the need for movable walls and/or liners. Faceted surfaces 130 and 131 also each have surface areas that narrow along the height of the block from the top surface towards the bottom surface. Faceted surfaces 130 and 131 may have any desired contour and may be curvilinear, planar, non-planar or any combination thereof. Geometric recess 112$G_2$ has faceted surface 134 and faceted surface 135. Faceted surface 134 extends angularly into block body 120 from vertically planar surface 133 and faceted surface 135 extends angularly into block body 120 from vertically planar surface 136 and from faceted surface 137 of geometric recess 112$G_3$, such that faceted surface 135 of geometric recess 112G2 abuts faceted surface 135 of geometric recess 112G3. Additionally, as can be seen in FIG. 5, both faceted surfaces 134 and 135 may have a drafting or angular contour extending into the block body along the height of the block body from the bottom surface 110 to the top surface 108, such that, the width and the depth of geometric recess 112$G_2$ increases from bottom surface 110 towards top surface 108. Faceted surfaces 134 and 135 also have surface areas that narrow along the height of the block from the top surface towards the bottom surface. This contouring/drafting allows the block to release from the mold cavity without the need for movable walls and/or liners. Faceted surfaces 134 and 135 may have any desired contour and, as such, faceted surface 134 may be planar and faceted surface 135 may be curvilinear, or non-planar. Vertically planar surface 136 only partially extends the height of front face 112 from the bottom face to the top face because of the proximity of geometric recess 112$G_2$ and geometric recess 112$G_3$ to one another along front face 112. The positioning, contour and dimension of geometric recesses located adjacent one another on a surface/face of a block effect the shape and size of the vertical planar surface located between adjacent geometric recesses, as such, the vertical planar surface may not fully extend the height of the block (the vertical planar surface may extend the partial height of the block from the bottom surface towards the top surface, or may extend the partial height of the block from the top surface towards the bottom surface). Geometric recess 112$G_3$ has faceted surface 137 and faceted surface 138. Faceted surface 138 extends angularly into block body 120 from vertically planar surface 113*a* and faceted surface 137 extends angularly into block body 120 from vertically planar surface 136 and from faceted surface 135 of geometric recess 112$G_2$. Additionally, as can be seen in FIG. 5, both faceted surfaces 137 and 138 may have a drafting or angular contour extending into the block body along the height of the body from the bottom surface 110 towards the top surface 108, such that, the width and the depth of geometric recess 112$G_3$ increases from bottom surface 110 towards top surface 108. Faceted surfaces 137 and 138 also have surface areas that narrow along the height of the block from the top surface towards the bottom surface. This contouring/drafting allows the block to release from the mold cavity without the need for movable walls and/or liners. Faceted surfaces 137 and 138 may have any desired contour and, as such, faceted surface 137 may be planar and faceted surface 138 may be curvilinear, or non-planar. The geometric or prismatic recesses or indentations create shadowing effects along the faces of the block that enhances the visual aesthetic of the block and gives the block more movement and randomness when the block is positioned in a wall or other structure. It should be understood that the number, location, shape and dimensions of geometric or prismatic recesses or indentations are not limiting and front face 112 could, therefore, have any number, location, shape or dimension of geometric or prismatic recesses or indentations as desired.

Each geometric indentation or recess formed into a face of the present invention has a first edge with a first vertically planar surface and a second edge with a second vertically planar surface. As can be seen in FIG. 3, angular planar faceted surface 134 of geometric indentation 112$G_2$ forms a linear or straight edge 133*a* with vertically planar surface 133 and non-planar faceted surface 135 forms curvilinear or convex edge 136*a* with vertically planar surface 136. Additionally, each faceted surface of a geometric indention forms an edge with at least one other faceted surface of the geometric indentation. Planar faceted surface 134 forms linear or straight edge 134*a* with non-planar faceted surface 135. The contour of the edge formed from the faceted surfaces of the geometric indentation may be determined by the contour of the faceted surfaces forming the edge and, as such, the edge could have various contours such as non-linear, curvilinear, concave, convex, etc. It should be understood that the edges formed by the faceted surfaces and the edges formed by the vertically planar surfaces and the faceted surfaces of the geometric recesses of the present invention are non-limiting and, as such, the edges can have any contour as desired.

False joint 112FJ of front face 112 extends into block body 120 from vertically planar surfaces 132 and 133. The false joint may have any dimension desired. The surfaces of the false joint may have angular slopes from the bottom surface of the block towards the top surface of the block and could have any degree of slope as desired. Additionally, the width and depth of the false joint may vary along the height of the block such that the false joint may widen/narrow or deepen/shallow from the bottom surface of the block towards the top surface of the block. In one desired embodiment, the surfaces that form the false joints could have vertical planar surfaces or could have drafting angles or drafting contours relative to their formation in a mold cavity so that they can be more easily stripped from the mold cavity. Additionally, as can be seen in FIGS. 1 and 2, the corners of the block may be provided/formed with surfaces that are similar to surfaces (or some of the surfaces) of a false joint so that when corners are placed adjacent to one another in a structure, the true joints and false joints have surfaces similar to each other and thus resemble each other. This similarity between surfaces of the false joint and the surfaces of the actual joint further contributes to the randomness and irregularity of the visually exposed surface of a structure and helps to hide the actual joints between blocks. The false joint (and true joints) creates further shadowing effects along the front face of the block that enhances the visual aesthetic of the block and gives the block more movement and randomness when the block is positioned in a wall or other structure. It should be understood that the number, location, shape and dimensions of false joints are not limiting and front face 112 could, therefore, have any number, location, shape or dimension of false joints as desired, or no false joints at all.

Figure 4:
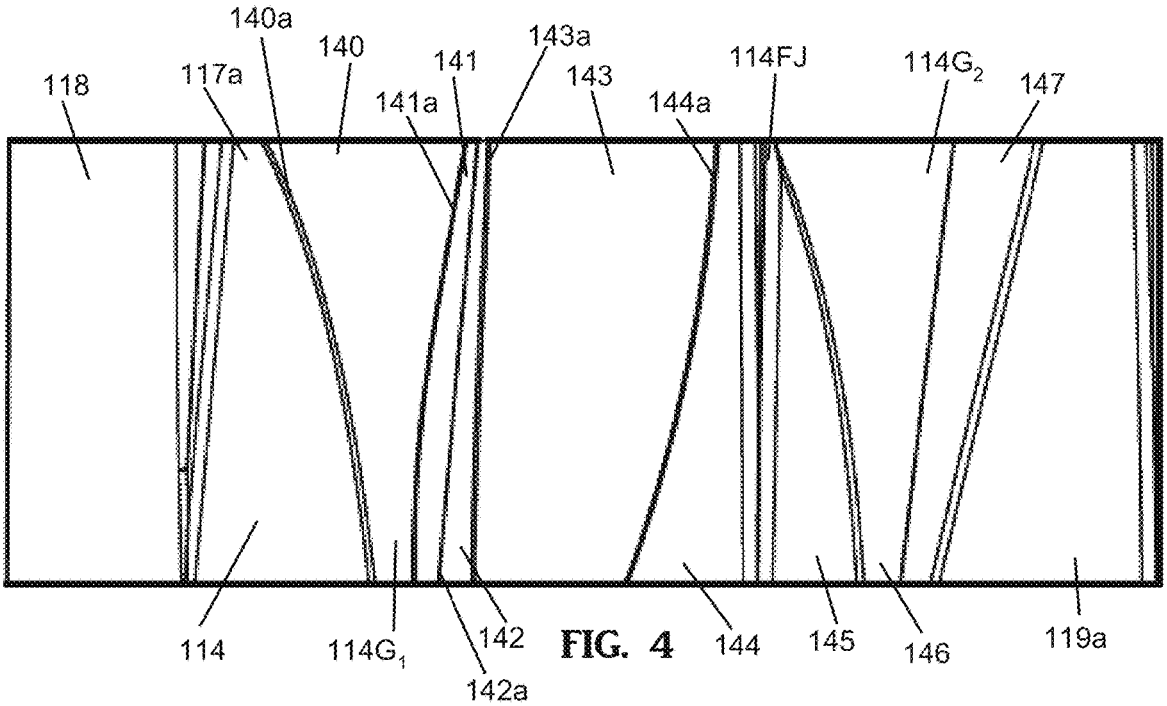

Referring to FIGS. 2, 4, and 6, rear or second face 114 of block 100 has geometric or prismatic indentation or recess 114$G_1$ and geometric or prismatic indentation or recess 114$G_2$ recessed or indented into the block body from the outermost surface of rear face 114. Each geometric recess of rear face 114 is formed from a corresponding geometric or prismatic projection in the liner of the mold cavity, as block 100 is molded. Rear face also has false joint 114FJ. Geometric recess 114$G_1$ has faceted surface 140, faceted surface 141, faceted surface 142 and faceted surface 143. Faceted surface 140 extends angularly into block body 120 from vertically planar surface 117*a* and faceted surface 143 extends angularly into block body 120 from vertically planar surface 144. Faceted surface 141 extends into block body 120 from faceted surface 140 and faceted surface 142 extends into block body 120 from faceted surface 143. Additionally, faceted surfaces 140, 141, 142 and 143 may have a drafting or angular contour extending into the block body along the height of the body from the bottom surface 110 to the top surface 108. As such, the width and the depth of geometric recess 114$G_1$ increases from bottom surface 110 towards top surface 108. This contouring/drafting allows the block to release from the mold cavity without the need for movable walls and/or liners. Faceted surfaces 140 to 143 may each have any desired contour and, as such, faceted surface 142 may be planar and faceted surfaces 140, 141 and 143 may be curvilinear, or non-planar. Faceted surfaces 140 and 143 also have surface areas that narrow along the height of the block from the top surface to the bottom surface, while the surfaces area of faceted surface 142 narrows from the bottom towards the top surface. Additionally, the surface area of faceted surface 141 along the height of the block from the bottom surface towards the top surface, widens and then narrows. Non-planar faceted surface 140 of geometric indentation 114$G_1$ forms a curvilinear or convex edge 140*a* with vertically planar surface 117*a* and non-planar faceted surface 143 forms curvilinear or concave edge 144*a* with vertically planar surface 144. Non-planar faceted surface 140 forms curvilinear or concave edge 141*a* with non-planar faceted surface 141. Non-planar faceted surface 141 forms linear or straight edge 142*a* with planar faceted surface 142. Planar faceted surface 142 forms linear or straight edge 143*a* with non-planar faceted surface 143.

Geometric recess 114$G_2$ has faceted surface 146 and faceted surface 147. Faceted surface 146 extends angularly into block body 120 from vertically planar surface 145 and faceted surface 147 extends angularly into block body 120 from vertically planar surface 119*a*. Vertically planar surface 145 only partially extends the height of rear face 114 from the bottom face to the top face because of the proximity of geometric recess 114$G_2$ to false joint 114FJ along rear face 114. As can be seen in FIG. 5, faceted surfaces 146 and 147 may have a drafting or angular contour extending into the block body along the height of the body from the bottom surface 110 to the top surface 108. As such, the width and the depth of geometric recess 114$G_2$ increases from bottom surface 110 towards top surface 108. This contouring/drafting allows the block to release from the mold cavity without the need for movable walls and/or liners. It should be understood that the number, location, shape and dimensions of geometric or prismatic recesses or indentations are not limiting and rear face 114 could, therefore, have any number, location, shape or dimension of geometric or prismatic recesses or indentations as desired or none at all.

Figure 7:
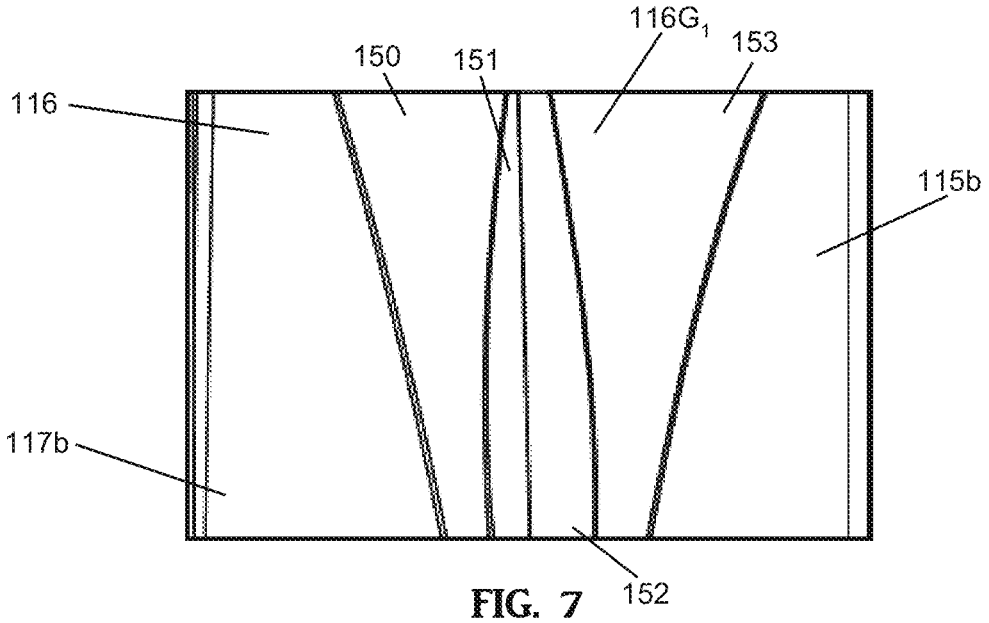
Figure 8:
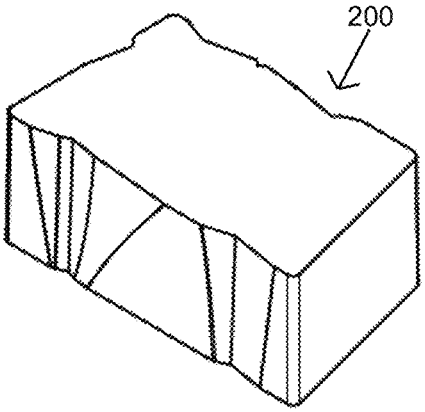
FIGS. 8 to 11 illustrate a perspective front view, a perspective rear view, a front view, and a rear view of an alternate embodiment of a wall block according to this invention.
Figure 9:
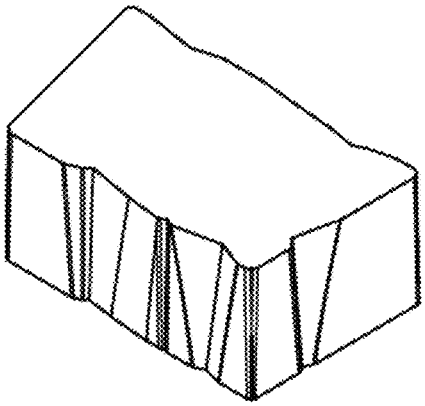
Figure 10:
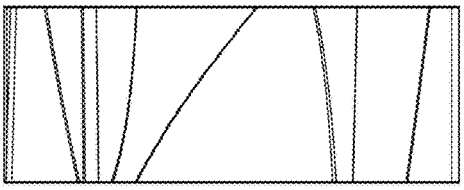
Figure 11:
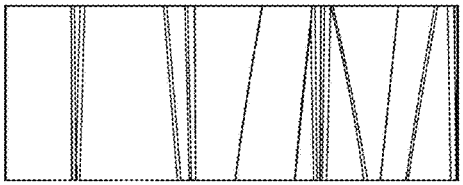
Figure 12:
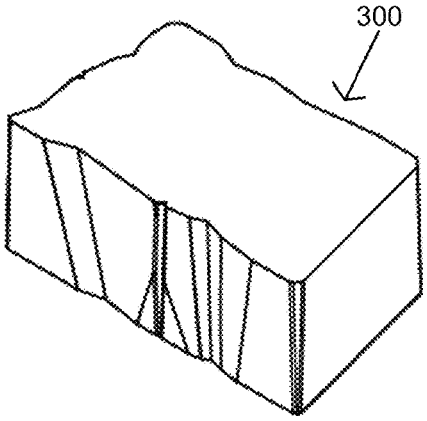
FIGS. 12 to 15 illustrate a perspective front view, a perspective rear view, a front view, and a rear view of an alternate embodiment of a wall block according to this invention.

Referring to FIGS. 2 and 7, first side surface 116 of block 100 has geometric or prismatic indentation or recess 116$G_1$ recessed or indented into the block body from the outermost surface of first side surface 116. Geometric recess 116$G_1$ is formed from a corresponding geometric or prismatic projection in the liner or side wall of the mold cavity, as block 100 is molded. Geometric recess 116$G_1$ has faceted surface 150, faceted surface 151, faceted surface 152 and faceted surface 153. Faceted surface 150 extends angularly into block body 120 from vertically planar surface 117*b* and faceted surface 153 extends angularly into block body 120 from vertically planar surface 115*b*. Faceted surface 151 extends into block body 120 from faceted surface 150 and faceted surface 152 extends into block body 120 from faceted surface 153. Additionally, faceted surfaces 150, 151, 152 and 153 may have a drafting or angular contour extending into the block body along the height of the body from the bottom surface 110 to the top surface 108. As such, the width and the depth of geometric recess 116$G_1$ increases from bottom surface 110 towards top surface 108. It should be understood that because the geometric indentations widen and deepen along the height of the block from the bottom surface towards the top surface, the bottom surface 110 of the block of the present invention will have a greater surface area than the top surface 108 of the block. This contouring/drafting allows the block to release from the mold cavity without the need for movable walls and/or liners. Faceted surfaces 150 to 153 may have any desired contour and, as such, faceted surfaces 150 to 153 may all be curvilinear or non-planar. It should be understood that the number, location, shape and dimensions of geometric or prismatic recesses or indentations are not limiting and first side surface 116 could, therefore, have any number, location, shapes or dimension of geometric or prismatic recesses or indentations as desired.

The vertical planar surfaces of faces 112 and 114 along with the vertical planar surfaces of first side surface 116 create vertically planar outermost surfaces of the block body that provide for increased durability during the shipping of the blocks by allowing vertical surfaces of adjacent blocks to abut one another for enhanced block stackability, packaging and shipping.

It should be understood that the vertical and faceted surfaces of faces 112 and 114 and first side surface 116 may have any desired number, size, shape or dimension as desired, with further examples being seen in FIGS. 8 to 27. Further, the edges or borders of each vertical and faceted surface can be linear, curvilinear, other, or any combination thereof as desired, with further examples being seen in FIGS. 8 to 27. The faceted surfaces of each geometric recess may slope at any desired angle from the bottom surface of the block to the top surface of the block or from the top surface of the block to the bottom surface of the block as desired. The faceted surfaces of each geometric recess may also extend into the block body at any desired angle as desired. Additionally, the geometric recesses may widen/narrow and deepen/shallow from the bottom surface of the block towards the top surface of the block as desired (and relative to the type of mold utilized during the block formation process). Further examples can be seen in FIGS. 8 to 27. It should also be understood that the shape of the geometric recess of the block and corresponding geometric projection of the mold liner (fixed or removable) used to create the geometric recess in the block can have any size or dimension and can also vary from simplistic to complex/compound as desired.

Figure 17:
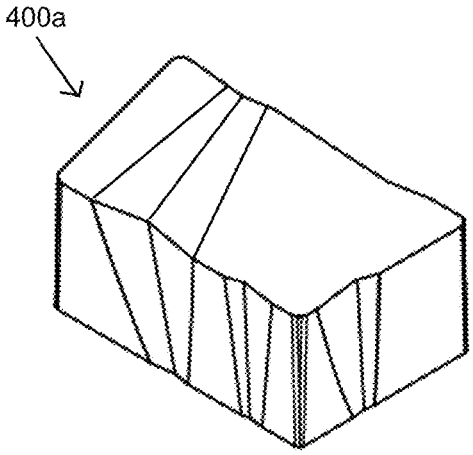
Figure 18:
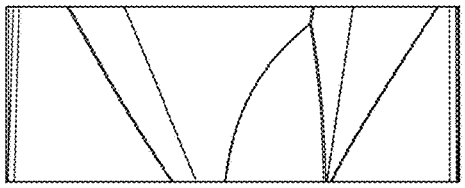
Figure 19:
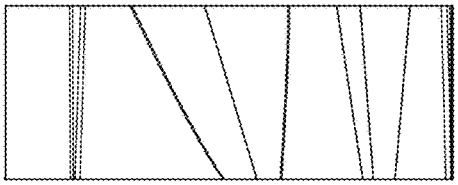

Blocks of the present invention may also have a top surface (alone or together with any or all of the front face, rear face and side faces) that has been molded with recesses or indentations with faceted surfaces as discussed above, an example of which can be seen on the top surface of block 400*a* in FIG. 17. The recesses or indentations and the faceted surfaces of the top surface may have any variations of contours, edges, depths, tapers and surface areas as seen and discussed herein. The blocks having the recesses or indentation molded into the top surface may be used in a capping or finishing layer in a structure assembled with the blocks of the present invention and may have the same or a different height from non-molded top surface block 100. Alternatively, these blocks could be used as edging or paving blocks. The recessed or indentations and each individual faceted surfaces may be formed in the top surface of the block (relative to the formation of the block a mold cavity) by projections on the stripper shoe, as known in the art. The projections on the stripper shoe may have a drafting angle or drafting contour that would allow for proper stripping and removal of the block from the mold cavity.

Optionally, the outermost surfaces of each or some of the side surfaces of the blocks of the present invention may be tapered planar contour. That is, for example, the surface area of the bottom of the block may be larger than the surface area of the top of the block.

Blocks 100 may be provided with a core, or passageway, not shown, preferably located generally at the center of the block. The core extends through the thickness of the block. The dimension of the core can be varied as desired. The block may also be provided with pin-receiving apertures and receiving channels. These apertures and receiving channels may be provided to use accept and retain pins to secure and align the blocks as desired.

In one desirable embodiment, all the faceted surfaces of each recess or indentation in each face of the block may have a drafting contour or drafting angle relative to the formation of each individual surface in a mold cavity, as known in the art, such that a block formed in a mold cavity may be readily stripped from the mold cavity. The mold cavity may have fixed or static side walls with no undercutting, and may have each geometric projection that forms the recess or indentation in the face of the block fixedly attached to each or any side wall of the mold cavity as desired. This manufacturing method allows for faster and lower cost block production. Additionally, the drafting contours/angles of the faceted surfaces result in the top surface of the block, relative to the formation in the mold cavity, having a smaller surface area than the bottom surface of the formed block. It should be understood however, that this is not limiting, and depending upon the application the mold cavity could utilize removable liners with movable mold cavity side walls.

Figure 13:
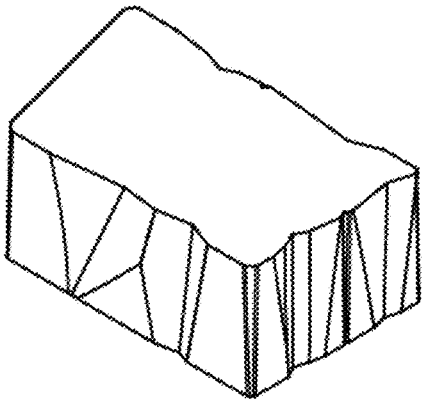
Figure 14:
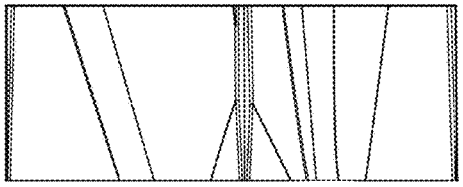
Figure 15:
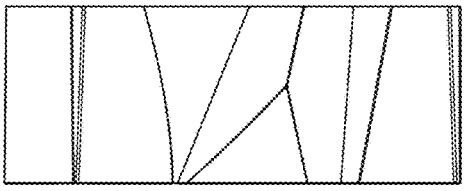
Figure 16:
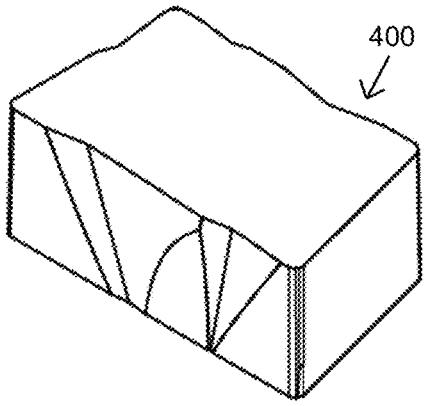
FIGS. 16 to 19 illustrate a perspective front view, a perspective rear view, a front view, and a rear view of an alternate embodiment of a wall block according to this invention.

FIGS. 8 to 11 show block 200, which is an alternate embodiment of block 100. FIGS. 12 to 15 show block 300, which is another alternate embodiment of block 100. As can be seen in FIG. 13, one of the geometric indentations is open/opens unto to the corner of the block formed with the front face. FIGS. 16 to 19 show block 400, which is another alternate embodiment of block 100. Block 400*a* seen in FIG. 17 is an embodiment which has a recess or indention formed in the top surface of the block. As can be seen, the top surface has at least a first geometric indentation recessed into the block body from an uppermost surface of the top surface, the geometric indentation separating a first horizontally planar portion of the uppermost surface of the top surface from a second horizontally planar portion of the uppermost surface of the top surface of the block. The geometric indentation has at least first and second faceted surfaces. It should be understood that the top surface of any of the blocks of the present invention could be formed with any number of indentations or recesses as desired. Additionally, the indentations could be formed with any number of faceted surfaces having any desired contour, shape, size or depth and may or may not extend the entire length or width of the top surface, from one side of the block to an opposed side (the sides of the block including the front, rear and side surfaces).

Additionally/alternatively the top surface of the block could be formed with a false joint that may extend across the top surface. The false joint of the top surface could extend from the false joint positioned on one of the sides of the wall block (the sides of the block including the front, rear and side surfaces) to a false joint on an opposing side. The false joint could also extend across the top surface from one of the sides to an adjacent side such that the false joint of the top surface is angled. The blocks shown in FIGS. 1 to 19 illustrate four block embodiments that can be used in varying combinations that form a wall system for the construction of a wall or other structure.

Figure 20:
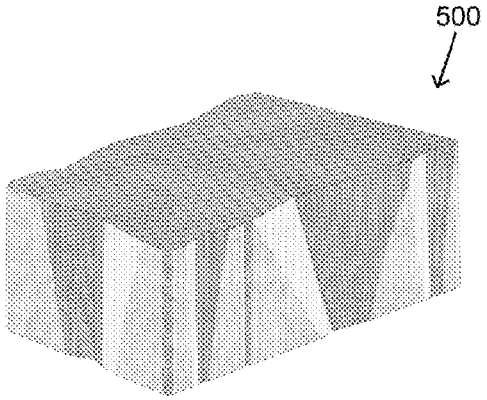
FIGS. 20 and 21 illustrate a perspective front view and a perspective rear view of an alternate embodiment of a wall block according to this invention.
Figure 21:
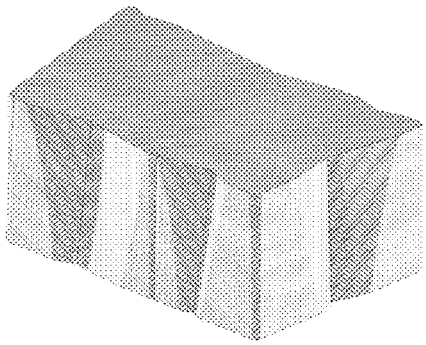
Figure 22:
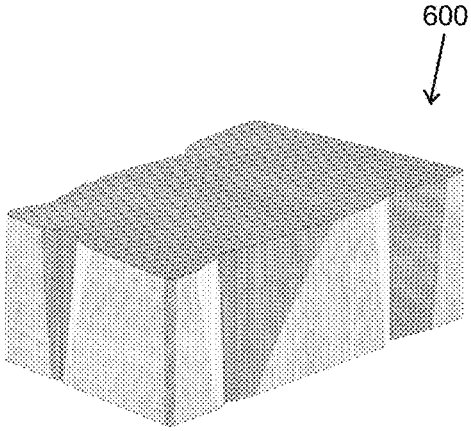
FIGS. 22 and 23 illustrate a perspective front view and a perspective rear view of an alternate embodiment of a wall block according to this invention.
Figure 23:
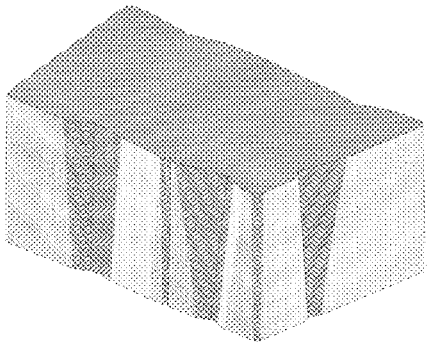
Figure 24:
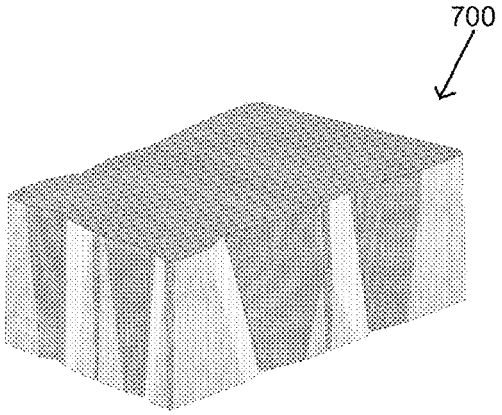
FIGS. 24 and 25 illustrate a perspective front view and a perspective rear view of an alternate embodiment of a wall block according to this invention.
Figure 25:
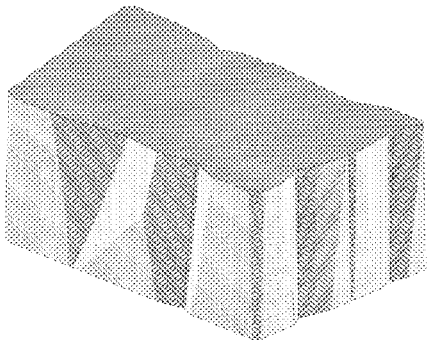
Figure 26:
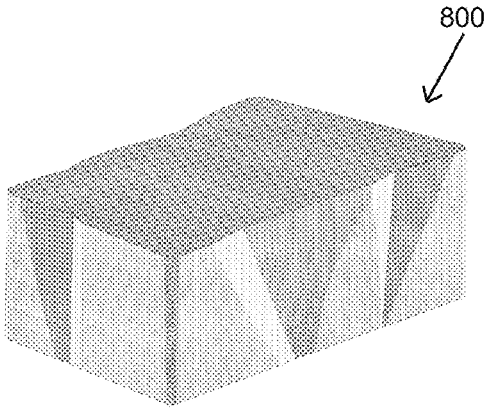
FIGS. 26 and 27 illustrate a perspective front view and a perspective rear view of an alternate embodiment of a wall block according to this invention.
Figure 27:
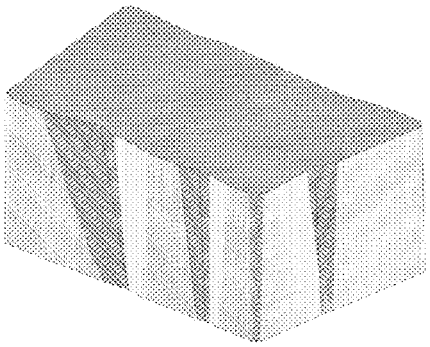

FIGS. 20 and 21 show block 500, which is an alternate embodiment of a block of the present invention. FIGS. 22 and 23 show block 600, which is another alternate embodiment of block 500. FIGS. 24 and 25 show block 700, which is another alternate embodiment of block 500. FIGS. 26 and 27 show block 800, which is an alternate embodiment of block 500. The blocks shown in FIGS. 20 to 27 illustrate four block embodiments that can be used in varying combinations that form a wall system for the construction of a wall or other structure.

The one or more geometric or prismatic recesses or indentations on each face of the block create shadowing effects along the faces of the block that enhance the visual aesthetic of the block. Additionally, the differing variations of recesses or indentations and the faceted surfaces that form each individual recess or indentation in the surfaces of the blocks used in the assembly of a wall or other structure give the visually exposed surfaces of the structure more visual movement, irregularity and randomness. Irregularity or irregular appearance in this context may be defined to mean that a regular geometric pattern is not readily apparent either in the individual face of the block or the visually exposed surface of a structure even though surfaces of the block, block faces and overall structure may consist of straight line segments or regular geometric curved segments. Further, the irregularity or randomness of the visually exposed surfaces of the structure may be enhanced by assembling the structure with multiple embodiments of blocks having different variations of indentations and recesses and with some of the blocks having the top surface of the block (as manufactured in a mold) facing upward and with some of the blocks with the bottom surface of the block (as manufactured in a mold) facing upward. Also, assembling the structure such that any of the front face, rear face or side faces may form any part of the visually exposed surfaces of the structure, whether the block be top side up, bottom side up and/or both will further enhance the irregularity and randomness of the visually exposed surface. The more randomness/irregularity when assembling/positioning the blocks in the structure also helps to create more randomness and irregularity in the visually exposed surfaces of the wall.

Figure 28:
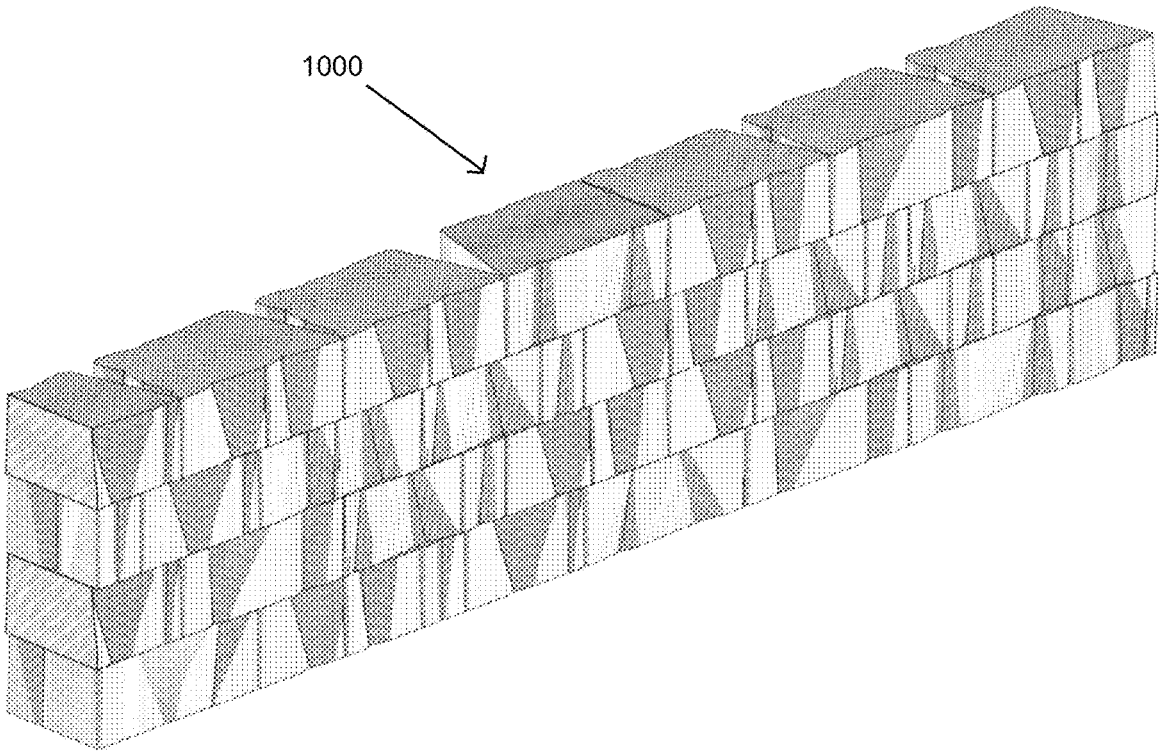
FIG. 28 is a perspective view of a partial wall constructed with the wall blocks of FIGS. 20 to 27.
Figure 29:
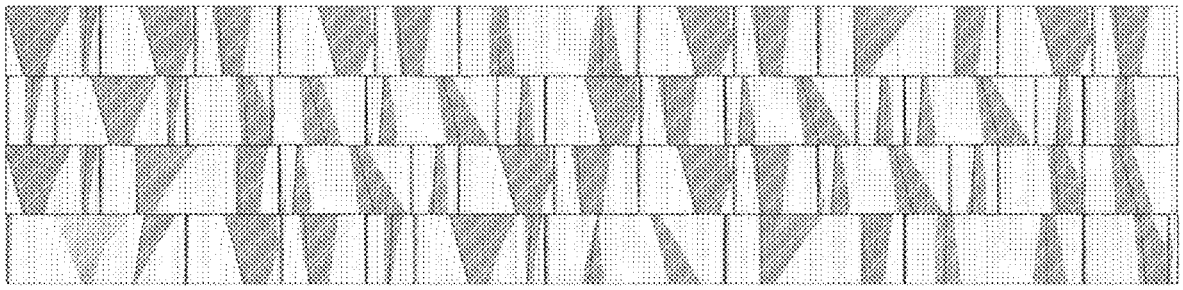
FIG. 29 is a front view of the partial wall of FIG. 28.

FIGS. 28 and 29 illustrate perspective and front views of a partial wall 1000 made from the multiple block system of the present invention, specifically using blocks 500, 600, 700 and 800. The first course of blocks of such a wall is typically laid in a trench and successive courses are laid one on top of the other. The weight of the blocks is sufficient to hold the blocks in place, although in some applications the bock may be provided with pin holes and pin receiving apertures whereby pins can be positioned in the pin holes and retained by the pin-receiving apertures to further hold the courses of blocks in place. In this illustration, four wall block embodiments corresponding to blocks 500, 600, 700 and 800, are used to form a wall having a front surface and a rear surface. Both the first and the second face of any one block may be used to form the front surface of the wall or the rear face of the wall. The first and second faces of one block also are different in surface area. These features contribute to the random appearance of the wall. Additionally, the blocks can be positioned with the upper surface facing upward or downward, further enhancing the overall aesthetic and desired random appearance of the wall since changing the orientation of the front face, rear face, first side surface and top and bottom surfaces of each block embodiment changes/alters the appearance/aesthetic of the design of the front face, rear face and side surface of each block embodiment. Further, the orientations of the block within the wall, along with the geometric recess and false joints of each exposed face of each block embodiment within the wall create a desired shadowing and three dimensional random irregular texture to the exposed wall faces that helps to hide joints between individual wall blocks within a course of blocks and between courses of blocks. Additionally, the randomness of the locations of the geometric recesses and false joints within the exposed surface of the wall gives the appearance that the lengths and heights of individual blocks within the wall may appear greater than or less than their actual dimensions. A cap or finish layer may be provided at the top of the wall.

Figure 30:
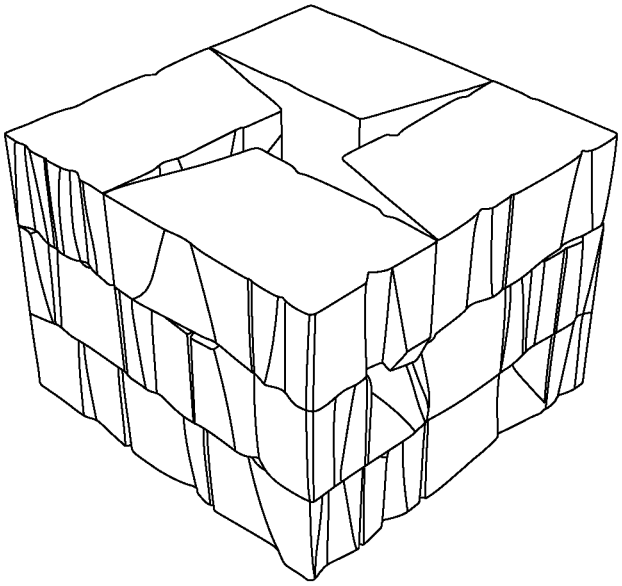
FIG. 30 is a perspective view of a column constructed with the wall blocks of the present invention.
Figure 31:
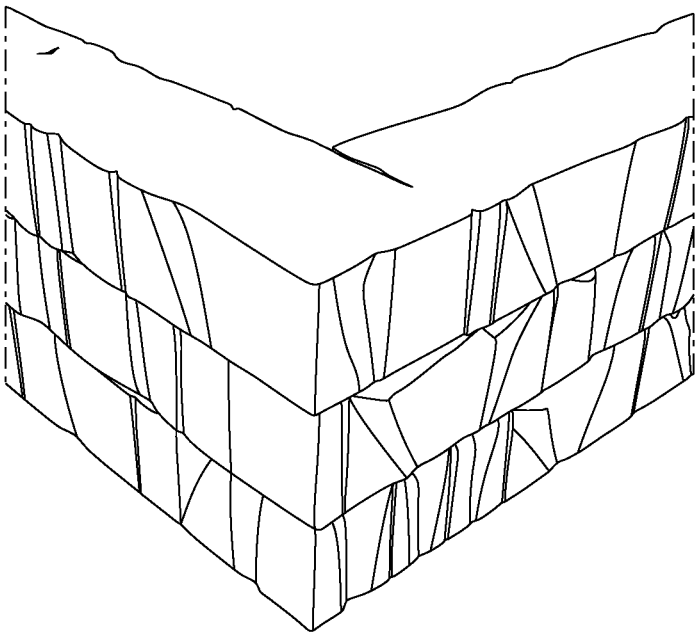
FIG. 31 is a perspective view of a partial wall having a 90° corner constructed with the wall blocks of the present invention.
Figure 32:
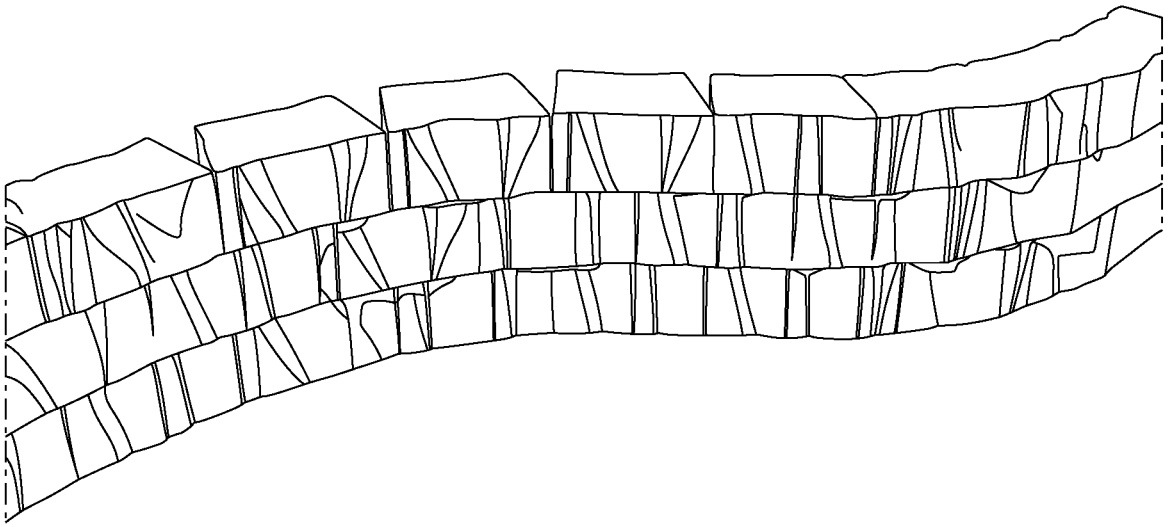
FIG. 32 is a perspective view of a partial wall having concave and convex curvature constructed with the wall blocks of the present invention.
Figure 33:
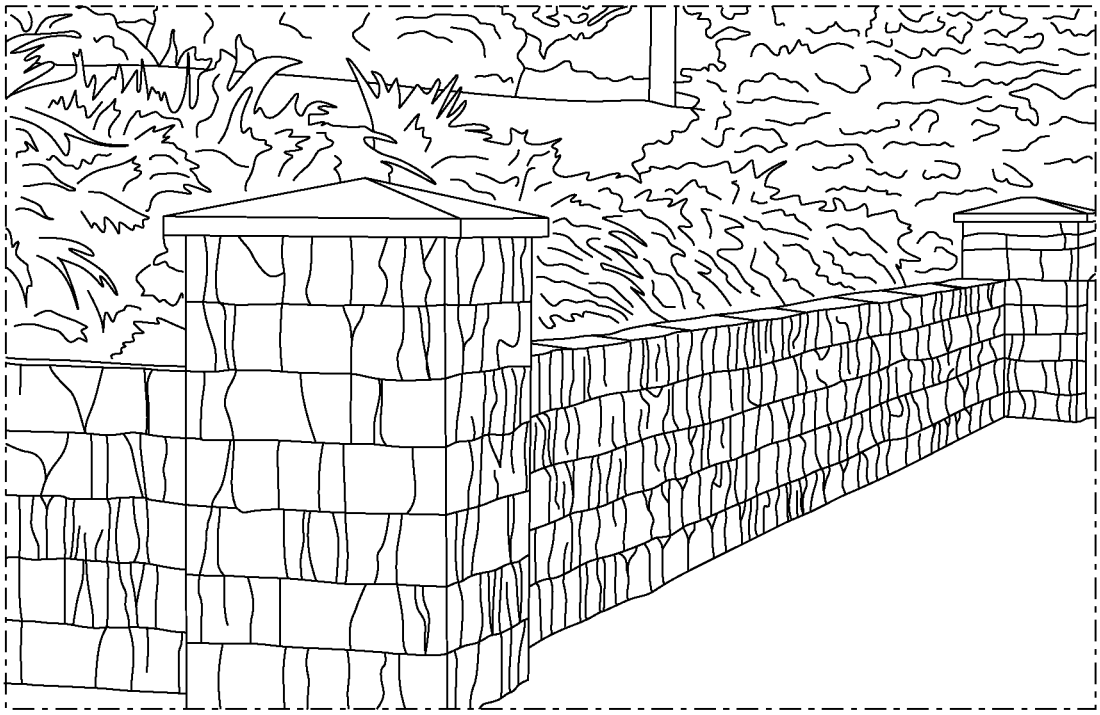
FIG. 33 is a perspective view of a wall and column system constructed with the wall blocks of the present invention.
Figure 34:
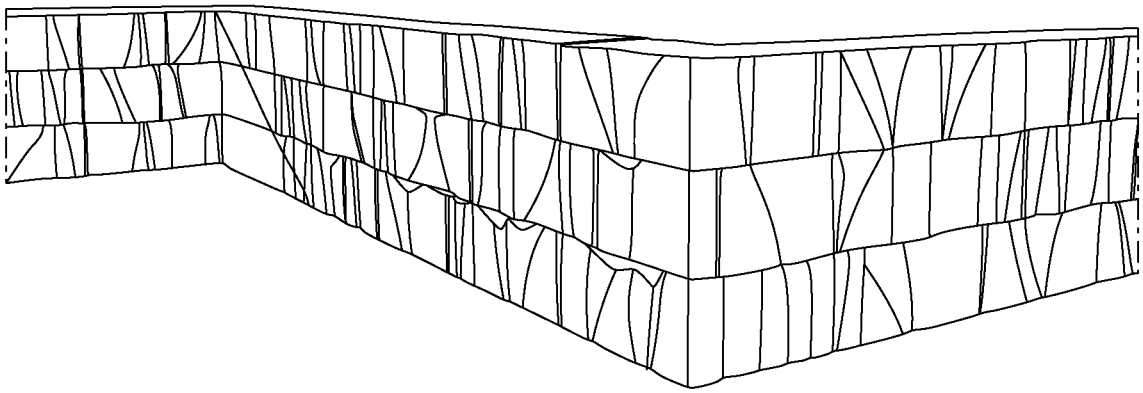
FIG. 34 is a perspective view of a wall having inner and outer 90° corners constructed with the wall blocks of the present invention.
Figure 35:
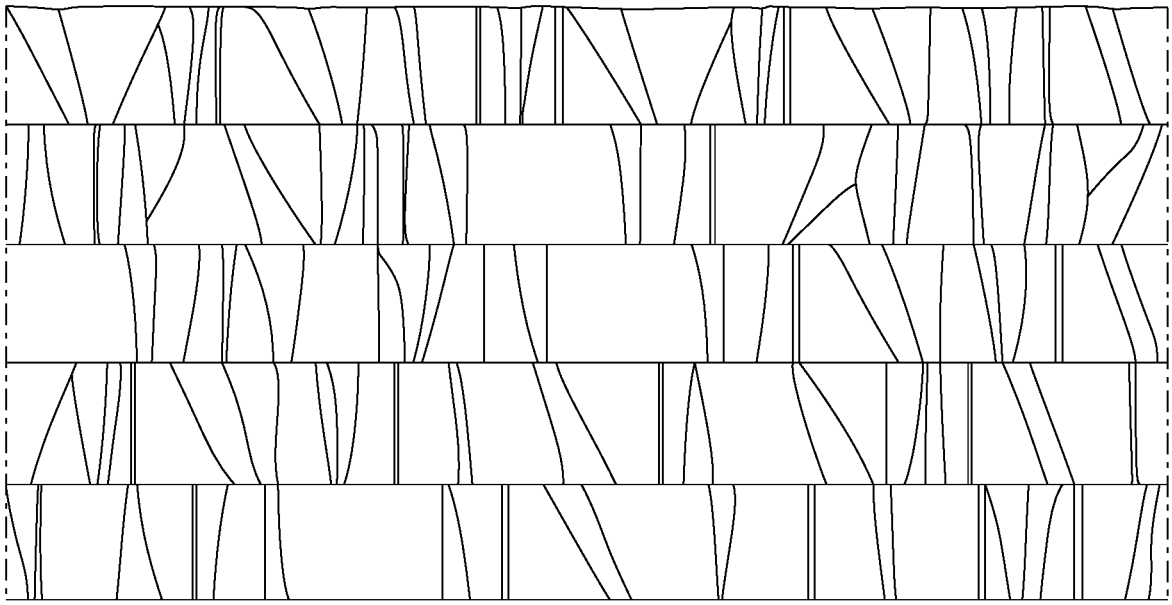
FIGS. 35 and 36 are front and perspective views of different configurations of the wall blocks of the present invention positioned within a constructed wall.
Figure 36:
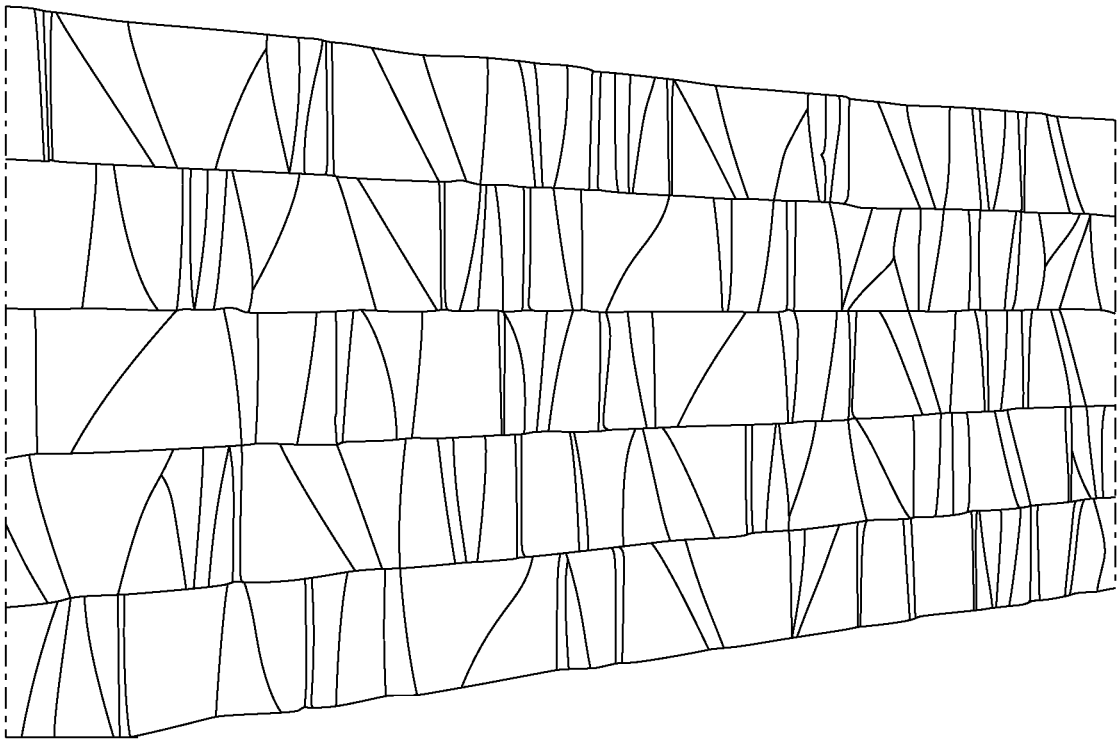

FIG. 30 illustrates a column made with the blocks of the present invention. FIG. 31 is a perspective view of a partial wall having a 90° corner constructed with the wall blocks of the present invention. FIG. 32 is a perspective view of a partial wall having concave and convex curvature constructed with the wall blocks of the present invention. FIG. 33 is a perspective view of a wall and column system constructed with the wall blocks of the present invention. FIG. 34 is a perspective view of a wall having inner and outer 90° corners constructed with the wall blocks of the present invention. FIGS. 35 and 36 are front and perspective views of different configurations of the wall blocks of the present invention positioned within a constructed wall. FIGS. 28 to 36 show multiple block embodiments positioned/assembled in the structures with some top surfaces facing upward and some bottom surfaces facing upward (as manufactured in a mold). FIGS. 28 to 36 also show the irregular/random appearance of the visually exposed surfaces of the structure with desirable shadowing effects along the individual faces of the block and the overall visually exposed surfaces of the structure that enhance the visual aesthetic of the blocks and assembled structure.

As can be seen in FIGS. 30, 31 and 34, an advantage of the block of this invention is that the as-manufactured block can be used in a wall having corners without any further surface treatment of the block. That is, both a front or rear face and a side face are visible in this wall at the corner and both have a random appearance. Because the blocks of this invention have one angled side, the blocks may be used to form 90 degree corners. A random appearance of the wall is achievable since all embodiments of the blocks may be used anywhere in a wall.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block comprising:

a block body having a top surface opposed to a bottom surface, a first side surface opposed to a second side surface, and a front surface opposed to a rear surface, the block body having a height as measured from the top surface to the bottom surface, the front, rear, first side and second side surfaces each having an outermost surface, at least one of the front, rear, first side and second side surfaces having at least a first geometric indentation recessed into the block body from the outermost surface, the first geometric indentation separating a first vertically planar portion of the outermost surface from a second vertically planar portion of the outermost surface, the first geometric indentation having at least first and second faceted surfaces, the first faceted surface having a planar contour and the second faceted surface having a non-planar contour, the first and second faceted surfaces each narrowing along the height of the block from the top surface towards the bottom surface, the first and second faceted surfaces each extending outward along the height of the block from the top surface towards the bottom surface, wherein the first vertically planar portion of the outermost surface forms a first edge with the first faceted surface of the first geometric indentation that is straight and the second vertically planar portion of the outermost surface forms a second edge with the second faceted surface of the first geometric indentation that is curvilinear.

2. The wall block of claim 1, wherein at least two of the front, rear, first side and second side surfaces have at least a first geometric indentation recessed into the block body from the outermost surface.

3. The wall block of claim 2, wherein at least one of the front, rear, first side and second side surfaces has at least a first geometric indentation and a second geometric indentation recessed into the block body from the outermost surface.

4. The wall block of claim 1, wherein at least one of the first and second vertically planar portions of the outermost surface does not extend the entire height of the wall block.

5. The wall block of claim 1, wherein the at least a first geometric indentation has first, second, third and fourth faceted surfaces.

6. The wall block of claim 5, wherein the third and fourth faceted surfaces are positioned between the first and second faceted surfaces, and the third and fourth faceted surfaces each widen along the height of the block from the top surface towards the bottom surface.

7. The wall block of claim 1, wherein at least one of the front, rear, first side and second side surfaces has at least a first geometric indentation and a second geometric indentation recessed into the block body from the outermost surface and a third vertically planar surface, the second geometric indentation separating the second vertically planar portion of the outermost surface from the third vertically planar portion of the outermost surface.

8. The wall block of claim 1, wherein the top surface has at least a first geometric indentation recessed into the block body from an uppermost surface, the first geometric indentation separating a first horizontally planar portion of the uppermost surface from a second horizontally planar portion of the uppermost surface, the first geometric indentation having at least first and second faceted surfaces.

9. A wall block system comprising:

a plurality of wall blocks having a block body with a top surface opposed to a bottom surface, a first side surface opposed to a second side surface, and a front surface opposed to a rear surface, the block body having a height as measured from the top surface to the bottom surface, the front, rear, first side and second side surfaces having an outermost surface, at least one of the front, rear, first side and second side surfaces having at least a first type geometric indentation recessed into the block body from the outermost surface, the first type geometric indentation separating a first vertically planar portion of the outermost surface from a second vertically planar portion of the outermost surface, wherein the first type geometric indentation has at least first and second faceted surfaces, the first faceted surface having a planar contour and the second faceted surface having a non-planar contour, the first and second faceted surfaces each narrowing along the height of the block from the top surface towards the bottom surface, the first and second faceted surfaces each extending outward along the height of the block from the top surface towards the bottom surface and wherein the first vertically planar portion of the outermost surface forms a first edge with the first faceted surface of the first type geometric indentation that is straight and the second vertically planar portion of the outermost surface forms a second edge with the second faceted surface of the first type geometric indentation that is curvilinear.

10. The wall block system of claim 9, wherein during the assembly of a structure having at least a first course of wall blocks with at least one visually exposed surface, any one of the plurality of wall blocks may be positioned in the at least one course with any of the front face, rear face or side surfaces forming a part of the visually exposed surface.

11. The wall block system of claim 10, wherein during the assembly of a structure having at least a first course of wall blocks with at least one visually exposed surface, any of the plurality of wall blocks may be positioned in the at least one course of wall blocks with the top surface of the wall block facing upward or the bottom surface of the wall block facing upward.

12. The wall block system of claim 10, wherein during the assembly of a structure having at least a first lower course of wall blocks and a second upper course of wall blocks with at least one visually exposed surface, the upper course of wall blocks is assembled with a plurality of wall blocks having a top surface with at least a first geometric indentation recessed into the block body from an uppermost surface, the first geometric indentation separating a first horizontally planar portion of the uppermost surface from a second horizontally planar portion of the uppermost surface, the first geometric indentation having at least first and second faceted surfaces.

13. The wall block system of claim 9, wherein at least one of the front, rear, first side and second side surfaces of at least some of the plurality of wall blocks has at least a second type geometric indentation recessed into the block body from the outermost surface, the second type geometric indentation separating one vertically planar portion of the outermost surface from another vertically planar portion of the outermost surface, wherein the second type geometric indentation has at least first and second faceted surfaces, the first faceted surface having a non-planar contour and the second faceted surface having a non-planar contour, and wherein one of the vertically planar portions of the outermost surface forms an edge with the first faceted surface of the second type geometric indentation that is curvilinear and the other of the vertically planar portion of the outermost surface forms an edge with the second faceted surface of the second type geometric indentation that is curvilinear.

14. The wall block system of claim 13, wherein at least one of the front, rear, first side and second side surfaces of at least some of the plurality of wall blocks has at least a third type geometric indentation recessed into the block body from the outermost surface, the third type geometric indentation separating one vertically planar portion of the outermost surface from another vertically planar portion of the outermost surface, wherein the third type geometric indentation has at least first and second faceted surfaces, the first faceted surface having a planar contour and the second faceted surface having a planar contour, and wherein one of the vertically planar portions of the outermost surface forms an edge with the first faceted surface of the third type geometric indentation that is straight and the other of the vertically planar portion of the outermost surface forms an edge with the second faceted surface of the third type geometric indentation that is straight.

15. The wall block system of claim 14, wherein at least one of the front, rear, first side and second side surfaces of each of the plurality of wall blocks has at least two of any of the first, second and third types of geometric indentations.

16. The wall block system of claim 14, wherein each of the front and rear surfaces and at least one of the first and second side surfaces of the plurality of wall blocks have at least one of any of the first, second and third types of geometric indentations.

17. The wall block system of claim 16, wherein at least one of the front, rear, first side and second side surfaces of at least some of the plurality of wall blocks has at least a fourth type geometric indentation recessed into the block body from the outermost surface, the fourth type geometric indentation separating a vertically planar portion of the outermost surface from another vertically planar portion of the outermost surface, wherein the fourth geometric indentation has at least first, second, third and fourth faceted surfaces and wherein at least two of the faceted surfaces are non-planar and at least one of the faceted surfaces is planar.

18. A mold assembly for producing wall blocks having a block body with a top surface opposed to a bottom surface, a first side surface opposed to a second side surface, and a front surface opposed to a rear surface, the block body having a height as measured from the top surface to the bottom surface, the front, rear, first side and second side surfaces having an outermost surface, at least one of the front, rear, first side and second side surfaces having at least a first geometric indentation recessed into the block body from the outermost surface, the first geometric indentation separating a first vertically planar portion of the outermost surface from a second vertically planar portion of the outermost surface, the first geometric indentation having at least first and second faceted surfaces, the first faceted surface having a planar contour and the second faceted surface having a non-planar contour, the first and second faceted surfaces each narrowing along the height of the block from the top surface towards the bottom surface, the first and second faceted surfaces each extending outward along the height of the block from the top surface towards the bottom surface, the mold assembly comprising:

a production pallet;

a stripper shoe; and a mold box including opposed front and rear walls and opposed first and second side walls which together with the front and rear walls form a perimeter of at least one mold cavity shaped to form a block during a block forming process, the mold box having an open top and an open bottom, the production pallet enclosing the open bottom of the mold box during a block forming process, the stripper shoe enclosing at least a portion of the open top of the mold box during a block forming process, at least one of the front and rear walls of the mold assembly having a molding surface that forms the at least first geometric indentation into the at least one of the front, rear, first side and second side surfaces of the wall block.

19. The mold assembly of claim 18, wherein the stripper shoe has a molding surface and wherein the molding surface of the stripper shoe molds at least a first geometric indentation into the block body in the top surface of the block, the first geometric indentation separating a first horizontally planar portion of the uppermost surface of the top surface from a second horizontally planar portion of the uppermost surface, the first geometric indentation having at least first and second faceted surfaces.

20. The mold assembly of claim 18, wherein at least one of the front, rear, first side and second side surfaces of the block body of the wall block has at least a first geometric indentation and a second geometric indentation recessed into the block body from the outermost surface and a third vertically planar surface, the second geometric indentation separating the second vertically planar portion of the outermost surface from the third vertically planar portion of the outermost surface.

* * * * *